US006851730B2

(12) United States Patent
Haab et al.

(10) Patent No.: US 6,851,730 B2
(45) Date of Patent: Feb. 8, 2005

(54) DEVICE FOR LOCKING A SEPARATIVE ELEMENT

(75) Inventors: Gregor Haab, Baar (CH); Hans Wüthrich, Wettswil (CH)

(73) Assignee: Hawa AG, Mettmenstetten (CH)

( * ) Notice: Subject to any disclaimer, the term of this patent is extended or adjusted under 35 U.S.C. 154(b) by 0 days.

(21) Appl. No.: 10/649,880

(22) Filed: Aug. 28, 2003

(65) Prior Publication Data

US 2004/0046398 A1 Mar. 11, 2004

(30) Foreign Application Priority Data

Sep. 6, 2002 (EP) ..... 02405775

(51) Int. Cl.[7] ..... E05C 19/10
(52) U.S. Cl. ..... 292/103; 292/DIG. 46
(58) Field of Search ..... 292/103, 106, 292/107, 203, 204, 207, 209, DIG. 46, 252, DIG. 15

(56) References Cited

U.S. PATENT DOCUMENTS 2,239,947 A * 4/1941 Vanderveld ..... 312/139.2
2,595,436 A * 5/1952 Abdallah et al. ..... 292/204
3,023,601 A * 3/1962 Luikart et al. ..... 70/297
3,785,684 A * 1/1974 Nakanishi ..... 292/241
4,391,461 A * 7/1983 Deibele ..... 292/204
5,203,596 A * 4/1993 Stevens ..... 292/204
6,106,032 A * 8/2000 Och ..... 292/207
6,155,616 A * 12/2000 Akright ..... 292/207
6,227,581 B1 * 5/2001 Lambert ..... 292/200
6,550,824 B1 * 4/2003 Ramsauer ..... 292/126

FOREIGN PATENT DOCUMENTS

| | | |
|---|---|---|
| DE | 44 28 718 A1 | 2/1996 |
| DE | 195 38 485 C2 | 4/1997 |
| EP | 0 537 121 A1 | 4/1993 |
| GB | 986941 | 3/1965 |
| WO | WO 00/55460 | 9/2000 |

* cited by examiner

*Primary Examiner*—Gary Estremsky
(74) *Attorney, Agent, or Firm*—Oliff & Berridge, PLC

(57) ABSTRACT

The function of the device is to lock, manually or automatically, separative elements which are mounted so as to be rotatably and/or laterally movable, specifically, doors, windows, partitions, shutters and coverings, which have a base profile which serves to accommodate a support device by which a locking element is retained, which element may be shifted between an unlock position and a lock position in which the locking element engages a receptacle fixed outside the base profile. According to an aspect of the invention, the function of the support device is to support a lever which is provided with the locking element and a head-piece enabling operation in such a way that this lever is retained in a rotatable fashion and is able to be detachably fixed in at least one first position corresponding to the unlock position, and possibly in a second position corresponding to the lock position.

18 Claims, 8 Drawing Sheets

DEVICE FOR LOCKING A SEPARATIVE ELEMENT

DEVICE FOR LOCKING A SEPARATIVE ELEMENT

The invention relates to a device, specifically, for manually locking one or more separative elements such as doors, windows, partitions, shutters, and coverings, which are mounted so as to be rotatably and/or laterally movable according to the preamble of claim 1.

An example of a device for manually locking two separative elements is known from European Patent 0537121A1 [1]. In the case of this locking device, a locking pin is arranged laterally on one of the separative elements and is manually insertable into a socket provided at the floor by means of a lever located at the facing side of the second separative element. Bringing the two separative elements together thus causes the device to lock, which elements additionally should be aligned in one plane so as to allow the components of the device to correctly engage. The closing separative elements must therefore be appropriately designed to accommodate the locking device. The components of the device are integrated in lateral, vertically oriented frame components so as to remain essentially invisible. As a result, it is almost impossible, or possible only at considerable cost, to install the device in previously fabricated separative elements.

German Patent 19538485C2 [2] describes a device for locking separative elements movable along a slide rail and provided with a base profile, which elements have a fork located within the base profile of the first separative element, and a locking pin mounted vertically in the base profile of the second separative element, the pin being captured by a fork provided with a lead bevel when the two separative elements meet and automatically pressed down into an floor socket recessed in the floor. Locking of the separative element provided with the locking pin here is therefore also only possible when the two separative elements meet and, as a result, occurs automatically. Non-automatic actuation of the locking pin located within the base profile for the device referenced in [2] is not provided and is essentially impossible. In addition, automatic locking of the separative elements is often not required or even desirable. When inserted into the floor socket, the locking pin also regularly comes into contact with dirt which is transported into the bearing of the locking pin and contaminates this component—with the result that the locking pin jams after an extended period of use, or is able to be moved only with considerable exertion of force. An appropriate level of maintenance is thus the rule for devices of this type.

In addition, the automatic locking of the described device requires relatively finely structured components, such as the driver pin attached to the vertically mounted locking pins, which may incur additional maintenance expense.

The goal of the invention is therefore to create a robust and compactly designed, manually operatable locking device which may be installed in a separative element with little effort and expense.

Specifically, the goal is to create a locking device with which a single separative element, or two or more separative elements, such as doors, windows, partitions, shutters, coverings, or elements of a stackable sliding wall may be locked.

An additional goal is to have two of the separative elements provided with the locking device be lockable even when not aligned in the same plane.

In a preferred embodiment, the manually operatable locking device should also be capable of automatic actuation.

This goal is achieved by the measures indicated in the characterizing section of claim 1. Advantageous embodiments of the invention are provided in subsequent claims.

The function of the device is to lock separative elements which are mounted so as to be rotatably and/or laterally movable, specifically, doors, windows, partitions, shutters and coverings, which have a base profile which serves to accommodate an installation device by which a locking element is retained which may be shifted between an unlock position and a lock position in which the locking element engages a receptacle fixed outside the base profile.

According to the invention, the installation device functions to support a lever which is provided with the locking element and a head-piece enabling operation in such a way that this lever is rotatably retained and is able to be detachably fixed, at least in a first unlock position, and possibly also in a second position corresponding to the lock position.

After installation of the locking device, the head-piece of the lever projects laterally from the base profile of the separative element and may thus be captured and actuated, as required, either manually or by a locking device provided in the base profile of a second separative element.

In a first preferred embodiment, the locking device thus enables manual actuation of the locking element, and thus retaining only the separative element provided with the locking device. Obviously, the head-piece of the lever may be actuated by the user not only by hand but also by foot motion.

Another embodiment of the invention provides for a second separative element with a closing device which functions to receive the head-piece of the lever. The first separative element may thus be arrested, after which the second separative element is pushed against the first separative element until the head-piece of the lever is captured by the closing device, preferably by a fork located on said closing device, and held between plates of the fork.

In another preferred embodiment, the fork plates have at least one ramp-shaped track, limited at the top and bottom, into which a guide element connected to the head-piece of the lever is able to be inserted and which is movable therein during the mutual movement of the two separative element in such a way that the lever is rotated from the first to the second position, or from the second to the first position, thereby automatically locking or unlocking the first separative element.

The fork plates are preferably provided with two guide tracks which enable the two separative elements to come together when the lever is located in the first unlocked or second locked position.

Appropriate selection of the fork plates and guide tracks may additionally be provided to ensure that the locking device always opens, or may always be opened manually, when the second separative element moves away regardless of the position of the lever when the separative elements come together. The user may thus adapt the locking device to his requirements by mounting the appropriate fork plates. In addition to manual operation of the locking device, automatic operation of the locking device is thus also possible.

The lever and attached guide elements may be of a very robust, possibly one-piece, design such that essentially maintenance-free operation of the locking device may be expected.

In another preferred embodiment of the locking device, the lever and/or support device, preferably, the support body, and/or the closing device, preferably the installation body, are provided with at least one damping element. As a result, impacts are absorbed which could be created when the separative elements meet, thereby reducing noise and stress on the device. Use of elastic damping elements also results in an advantageous flexibility in the head-piece and/or fork which allows these to be coupled even more easily.

In another preferred embodiment, the head-piece of the lever, and the fork of the closing device, are also designed in such a way that the head-piece is able to be inserted from different directions into the fork and is able to be rotated therein in a plane running perpendicular to the separative elements. The movable separative elements provided with the locking device may thus be movably mounted in curved guide tracks but joined and locked even though they are not aligned in the same plane. The head-piece of the lever may, for example, be of a wedge-shaped or spherical form.

In various embodiments, the locking device may be located on any side of the separative element in a base profile such that the locking element may engage a receptacle, possibly one provided with a socket, which is provided on the floor, ceiling or wall of the room.

The separative elements with the locking device are preferably guided along slide rails which are provided with detent devices which enable simple positioning of the separative elements at closing positions in which the locking element may engage a receptacle, possibly one provided with a socket or in the form of a guide rail, the receptacle being provided in the floor, ceiling or wall of the room.

In the event the receptacle is in the form of a guide rail, the locking element countersunk in the rail functions as a longitudinal guide for the separative elements when coupled, while simultaneously preventing any rotation of these elements.

In order to prevent undesired unlocking of the device, the lever of the locking device is able to be arrested in the second position, for example, by a pin which is accessible only from one side of the separative element.

The following discussion explains the invention in more detailed based on drawings.

FIG. 1 shows a locking device 100 according to the invention installed in a base profile 4 of the first separative element 8*a*, which locking device has a lever 1 which is rotatably mounted in a support body 21, and is provided with a head-piece 15 and a locking element 14.

Figure 1:
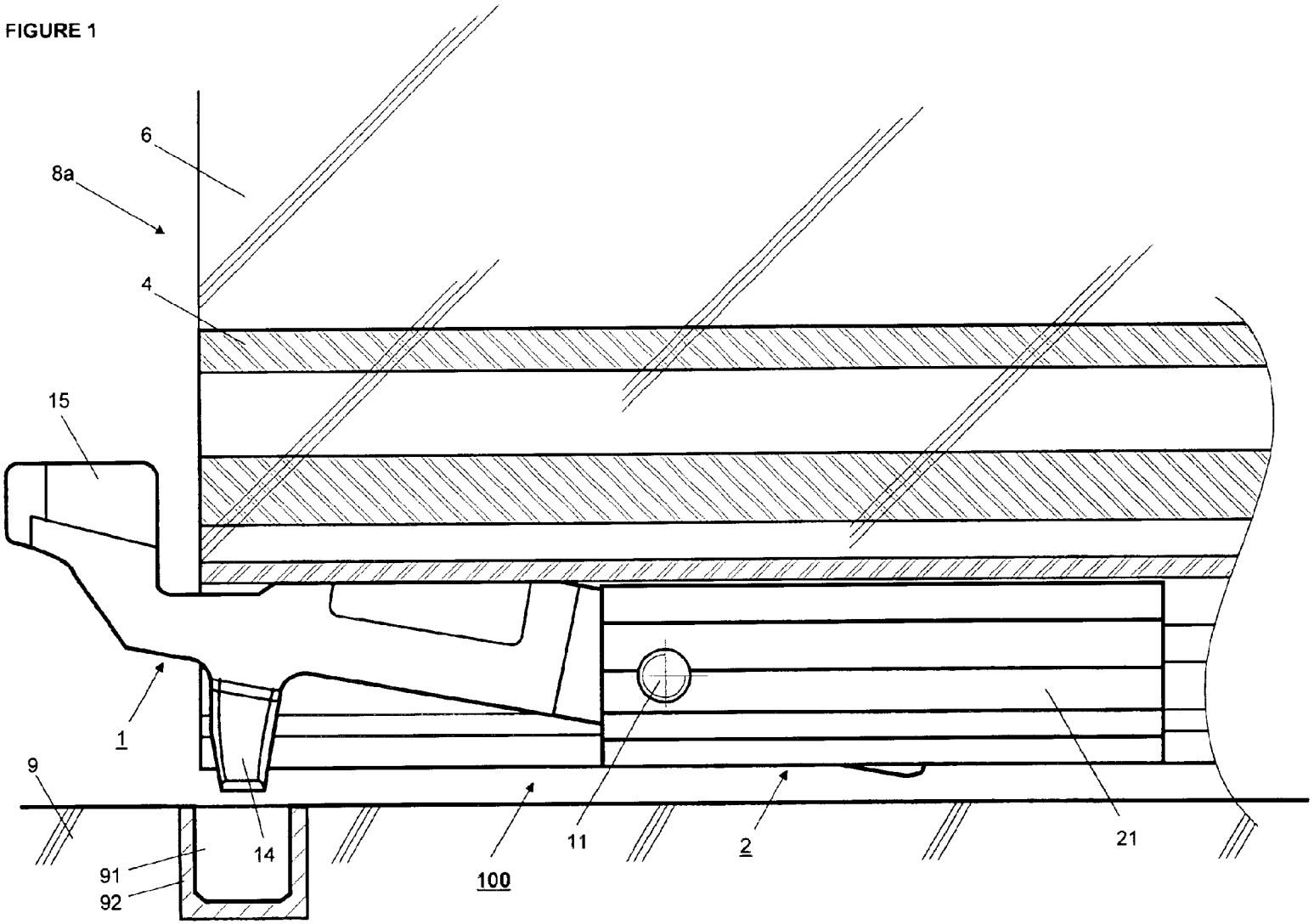
Figure 4:
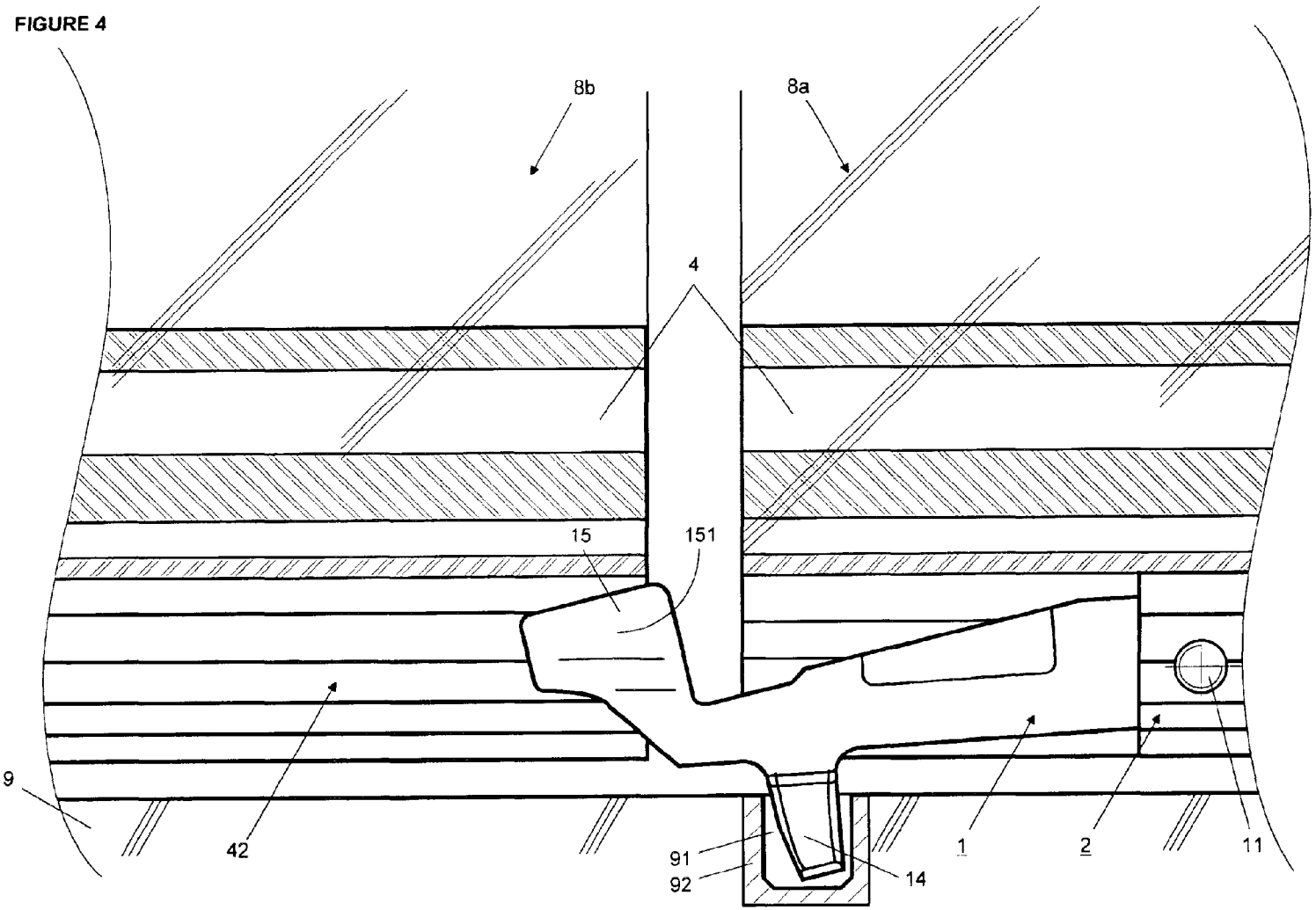

FIG. 4 shows locked locking device 100 of FIG. 1 with the head-piece 15 of lever 1 inserted into base profile 4 of a second separative element 8*b*.

Figure 5:
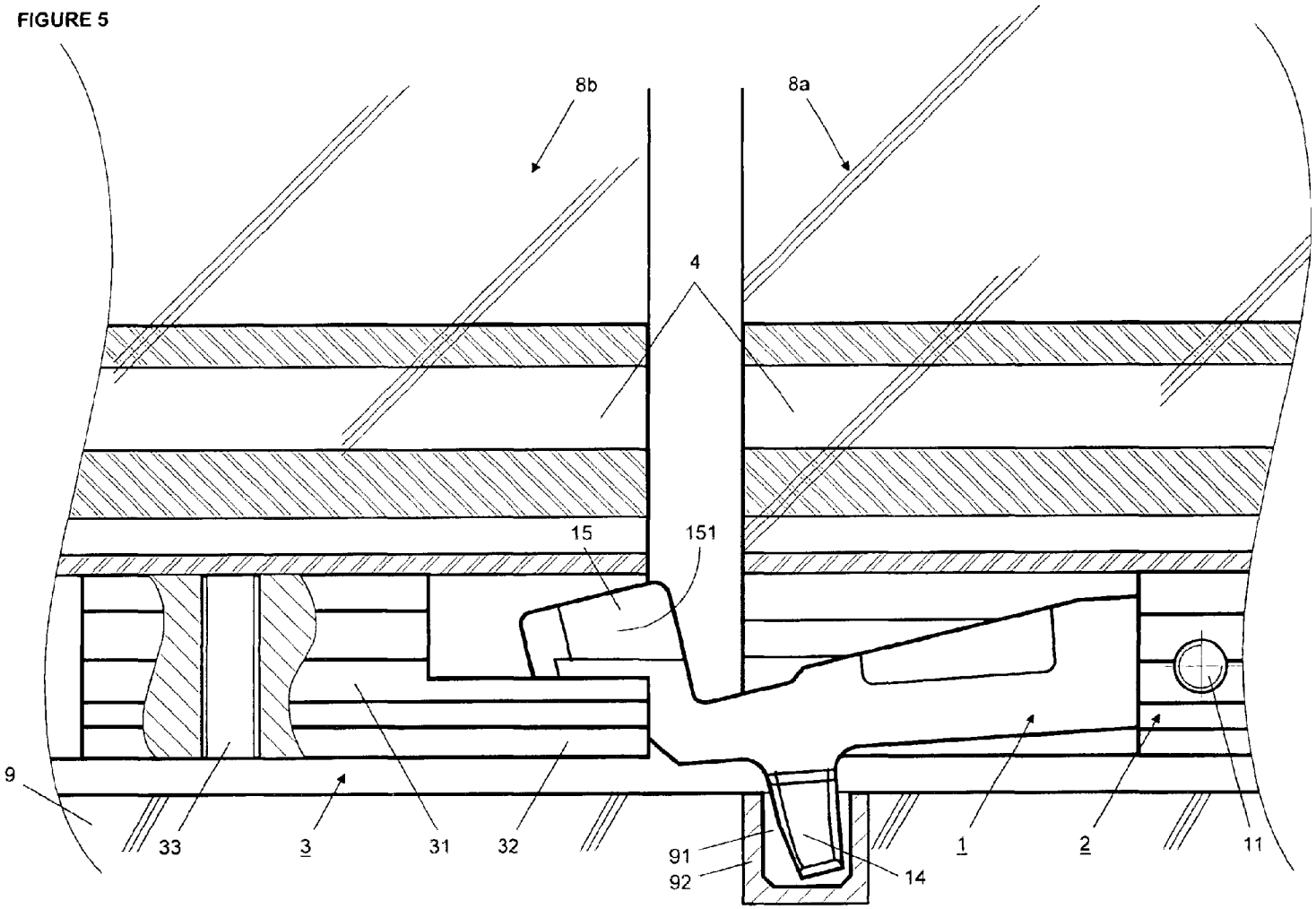

FIG. 5 shows locked locking device 100 of FIG. 1 with the head-piece 15 of lever 1 inserted into a closing device 3 which is located in base profile 4 of second separative element 8*b*.

Figures 6, 7, 8:
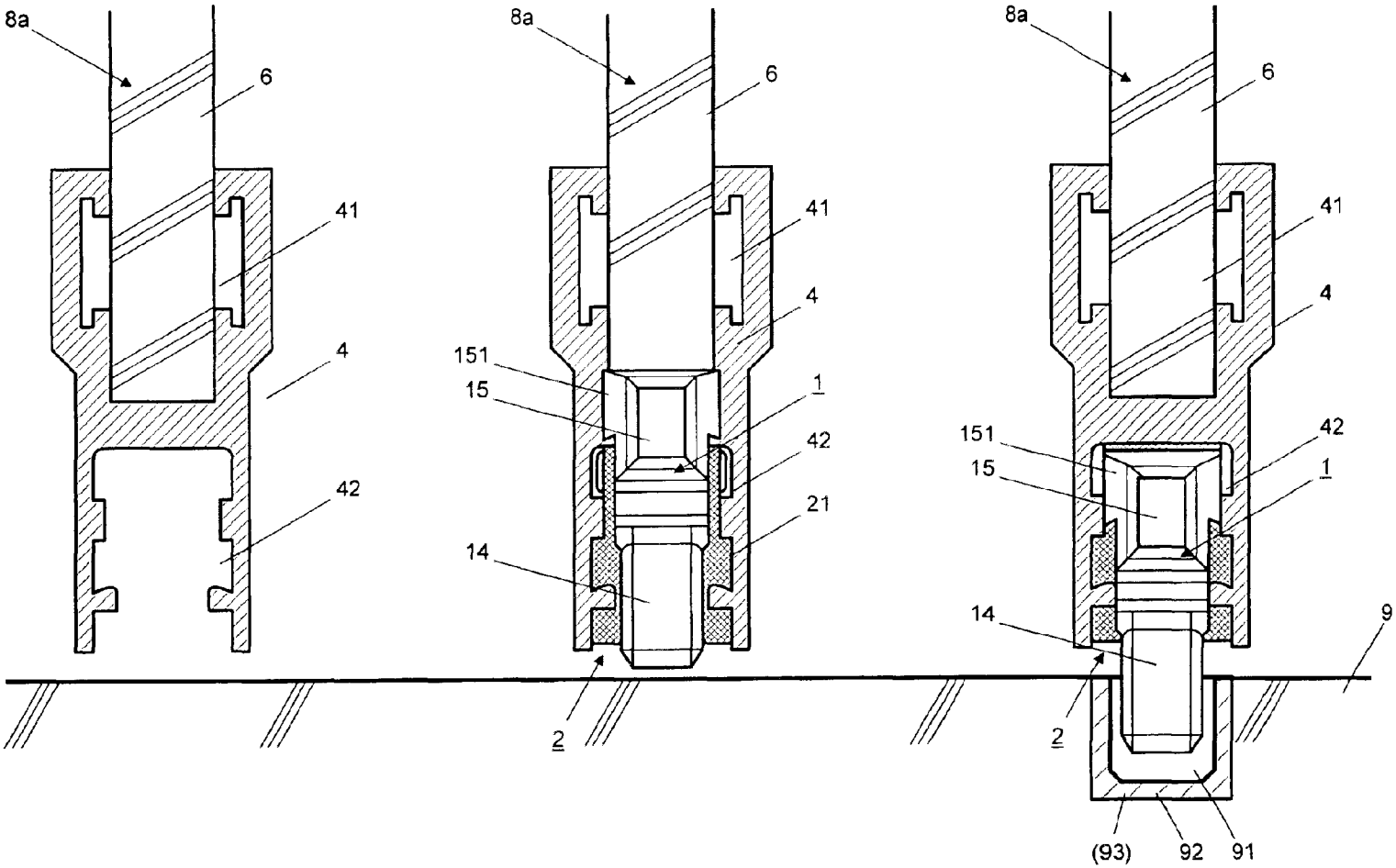

FIG. 6 shows separative element 8*a* with base profile 4 without locking device 100.

Figure 2:
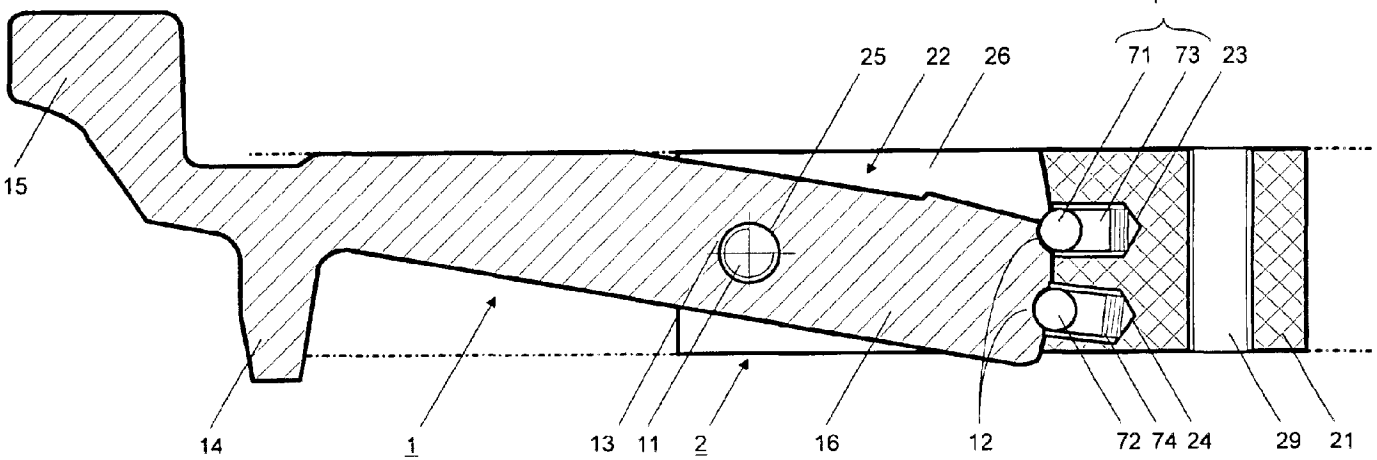
FIG. 2 shows sections of locking device 100 of FIG. 1, unlocked, with lever 1 fixed in a first position.

FIG. 7 shows separative element 8*a* with base profile 4, with locking device 100 and lever 1, in the position shown in FIG. 2.

Figure 3:
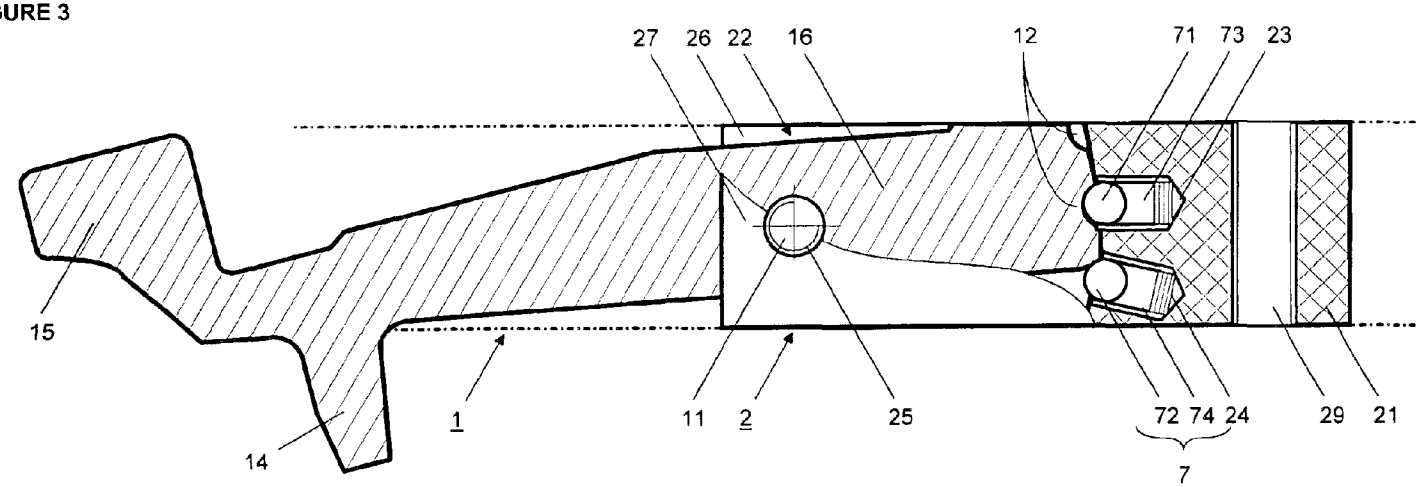
FIG. 3 shows sections of locking device 100 of FIG. 1, locked, with lever 1 fixed in a second position.

FIG. 8 shows separative element 8*a* with base profile 4, locking device 100, and lever 1 in the position shown in FIG. 3 in which locking element 14 engages a receptacle 91 which is located in the floor 9, provided with a socket 92, or formed by a guide rail 93.

Figure 9:
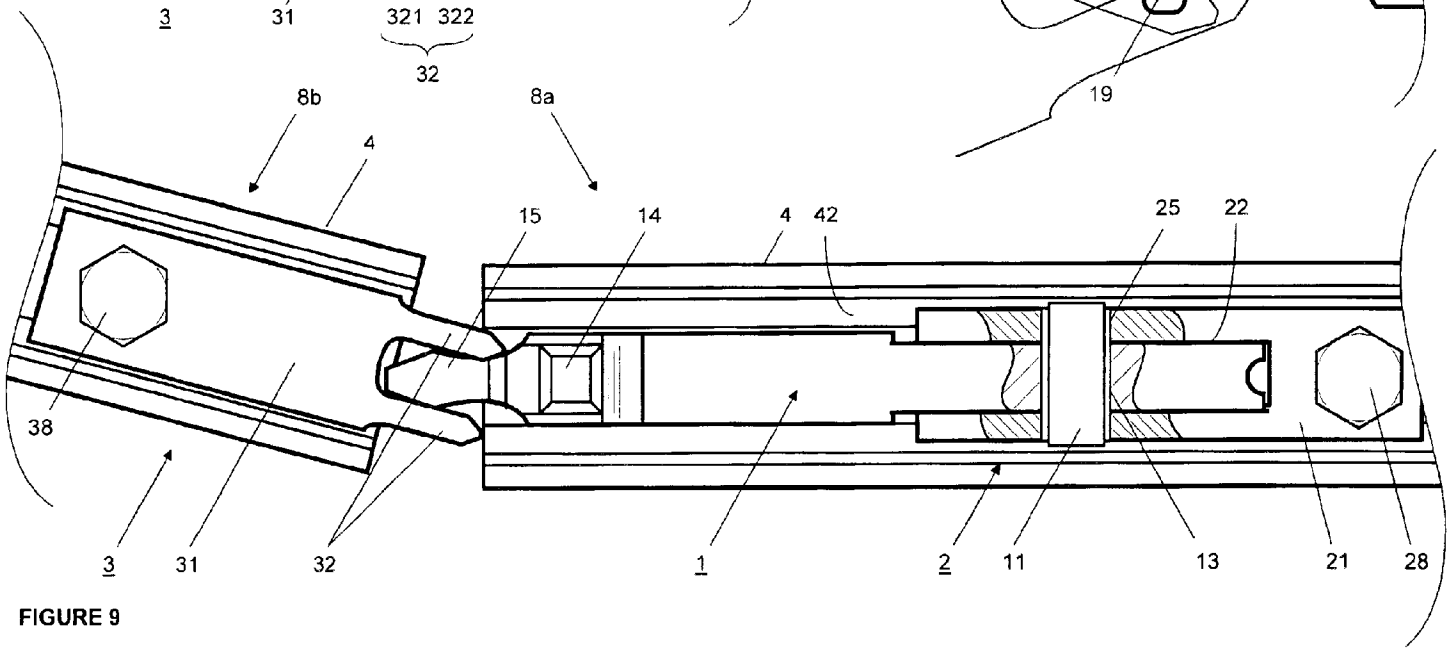

FIG. 9 is a bottom view of the first and second separative elements 8*a*, 8*b*, which are oriented obliquely relative to each other, and which are coupled and locked by lever 1 which engages a closing device 3 provided in base profile 4 of second separative element 8*b*.

Figure 10:
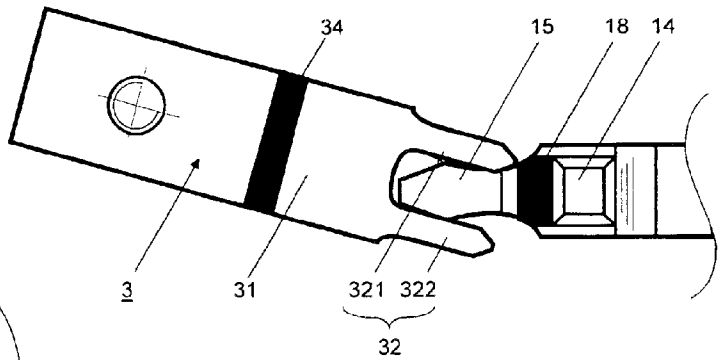

FIG. 10 shows lever 1 and closing device 3, provided with damping elements 18, 34.

Figure 11:
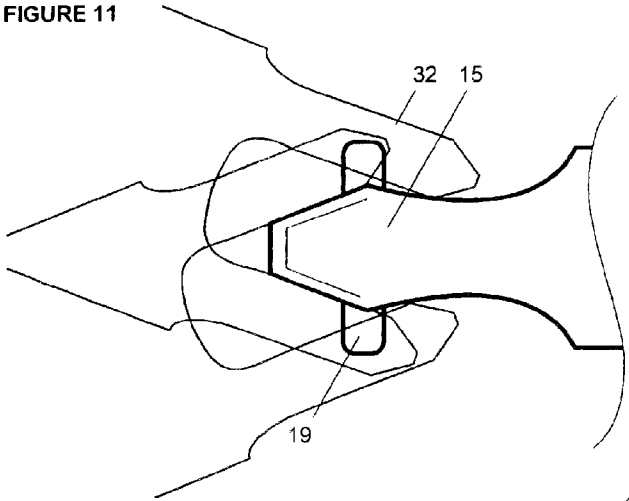

FIG. 11 is a schematic view of the front piece of closing device 3, the front piece being in the form of a fork 32, which front piece captures from two different directions the front piece 13 of lever 1 which is provided with stable guide elements 19.

Figures 12, 13:
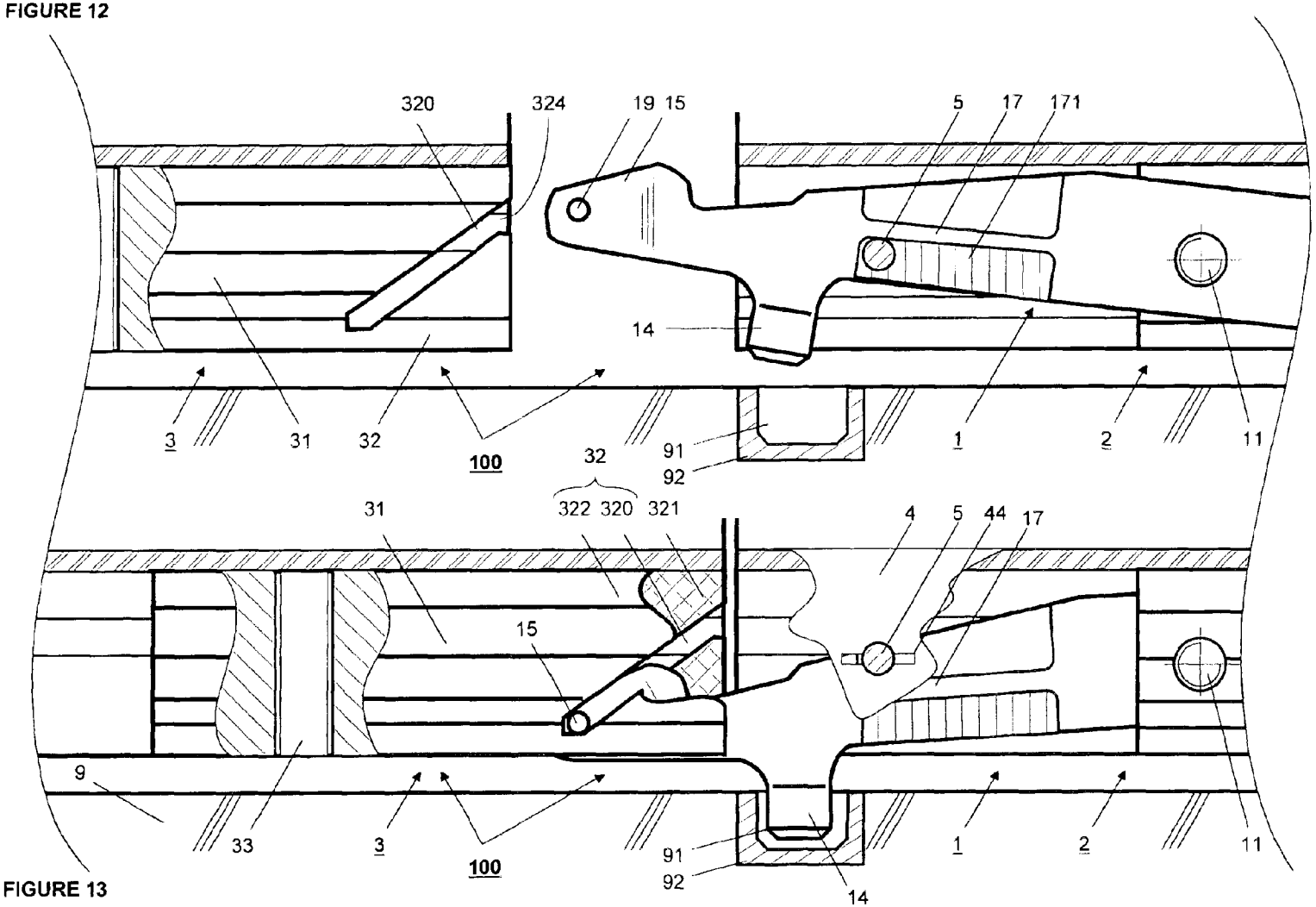

FIG. 12 shows fork 32 of closing device 3 which is provided with guide tracks 320 which function to receive and guide lever 1 which is thus automatically actuatable as well as arrestable by a pin 5.

FIG. 13 shows locking device 100 of FIG. 12, locked, and arrested and secured by pin 5.

Figure 14:
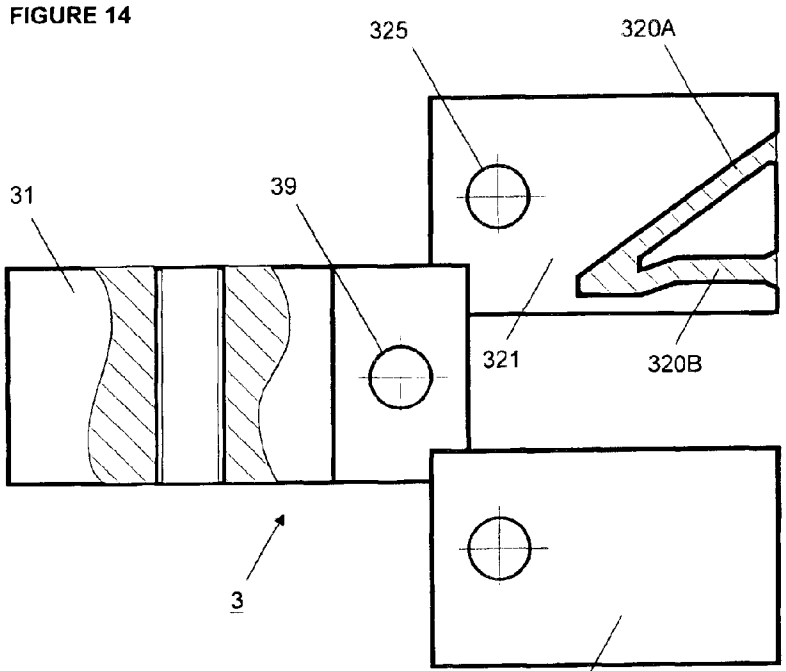

FIG. 14 shows closing device 3 with support body 31 on which two fork plates 321 and 322 may be installed.

Figure 15:
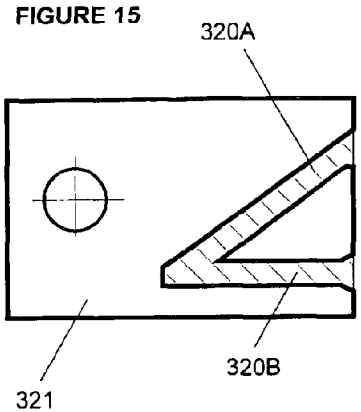

FIG. 15 shows a preferred embodiment of a fork plate 321.

Figure 16:
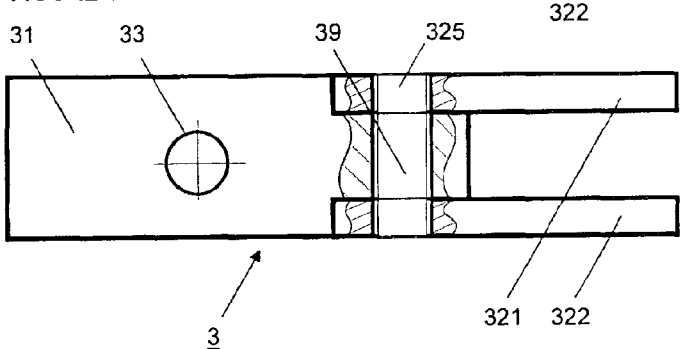

FIG. 16 is a top view of closing device 3 with installed fork plates 321, 322.

Figure 17:
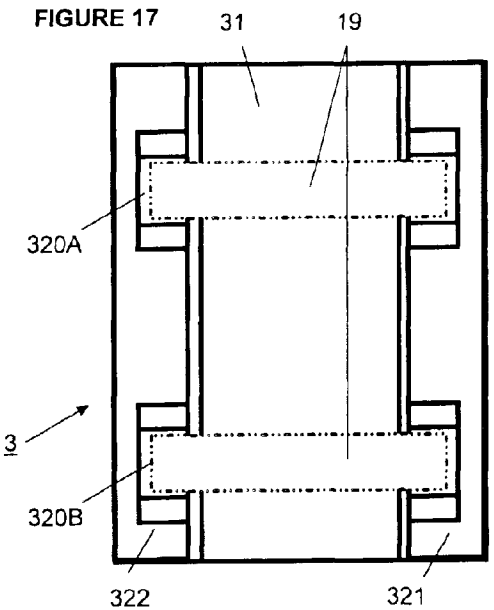

FIG. 17 is a front view of closing device 3 of FIG. 16, with installed fork plates 321, 322.

FIG. 1 shows locking device 100 according to the invention installed in a base profile 4 of first separative element 8*a*, which locking device has lever 1 which is rotatably mounted in support device 2, and is provided with head-piece 15 and locking element 14. Head-piece 15 of lever 1 projects laterally from base profile 4, seen in cross-section, and may thus be conveniently accessed and actuated manually by hand, or even by foot.

In the position shown for separative element 8*a*, lever 1 connected by a shaft 11 to support device 2 is able to be rotated downward to allow locking element 14 located on the bottom of lever 1 to be inserted into receptacle 91 which is formed by socket 92 countersunk into floor 9.

Separative element 8*a* provided with a glass pane 6 or other suitable materials is, for example, a sliding door which is movable along a side rail or may also possibly be rotatably mounted. In the region of receptacle 91, the slide rail is preferably provided with detent devices so as to enable separative element 8*a* to be easily positioned at predetermined closing positions. The method of mounting and positioning the separative elements is known to those skilled in the art (see, for example, reference [3], WO 00/55460).

FIG. 2 shows sections of locking device 100 of FIG. 1 with lever 1, shown in cross-section, detachably fixed in the unlocked first position. Support device 2 has a support body 21, insertable into base profile 4 and matched to the profile's interior dimensions, which is able to be fixed by at least one installation screw through a threaded hole 29 in support body 21. Support body 21 may thus be inserted by simple means into base profile 4 and arrested in the appropriate position by the installation screw. Support body 21 is also provided with side plates 26, 27 aligned against lever 1, between which plates a recess 22 is provided to accommodate end-piece 16 of lever 1. Side plates 26, 27, as well as lever 1, are provided with holes 25 through which shaft 11 runs such that lever 1 and support body 21, installed in base profile 4, may rotate towards each other in a plane running parallel to separative element 8*a*.

In order to detachably fix lever 1 in the first, unlocked, position, and preferably in a second, locked, position, elastic elements 7 are provided in holes 23, 24 of support body 21, which elements are pressed into indentations 12 in end-piece 16 of lever 1 at the appropriate positions of lever 1. In the embodiment shown in FIG. 2 and FIG. 3, elastic elements 7 are balls 71, 72 which are pressed against lever 1 by spring elements 73, 74.

FIG. 3 and FIG. 4 show lever, fixed by elastic elements 7 in the second position in which device 100 is locked.

FIG. 4 also shows how head-piece 15 serving to operate lever 1, which head-piece projects laterally from base profile 4 of first separative element 8*a*, is able to be inserted into base profile 4 of second separative element 8*b*. Head-piece 15 here is preferably matched to second separative element 8*b* so that it may easily insert into base profile 4 and retain this profile with almost no play as soon as second separative element 8*b* has been moved completely against first separative element 8*a*. After first separative element 8*a* has been locked, second separative element 8*b* may thus move against first separative element 8*a* such that this element is also held in a rotationally fixed position.

FIG. 5 shows how head-piece 15 operating lever 1 inserts into closing device 3 which is located in base profile 4 of second separative element 8*b*. The preferably employable closing device 3 allows for an improved, possibly more flexible, retention of head-piece 15—as will be explained below.

Closing device 3 has an installation body 31 which is able to be inserted, like support body 21, into base profile 4, and arrested in the base by at least one installation screw which is able to pass through threaded hole 33 provided in installation body 31. The front of the installation screws are provided, for example, with a cup point which is screwed into base profile 4 in positive engagement such that support body 21 and installation body 31 are arrested and held immovable. In addition, the bottom of support body 21 and installation body 31 may be provided with edges which penetrate base profile 4 when the installation screws are tightened. On the front, installation body 31 is provided with fork 32 directed toward lever 1, by which fork head-piece 15 of lever 1 is partially clasped and held.

FIG. 5 additionally shows how a recess is maintained within base profile 4 above fork 32, into which recess a wide upper section 151 of head-piece 15 is able to be inserted.

FIG. 6 shows the front side of first separative element 8*a* with base profile 4 which is in the form of an H and is thus provided with an upper channel 41 to accommodate glass pane 6, for example, and a lower channel 42 to accommodate support body 21 of installation body 31.

FIG. 7 shows separative element 8*a* with support body 21 inserted into base profile 4, and with lever 1 fixed in the first, unlocked, position. In this position, head-piece 15 of lever 1 situated at the level of first channel 41 is not able to be inserted into closing device 3. If the purpose is to allow head-piece 15 to be inserted into closing device 3 independently of the position of lever 1, then head-piece 15 must be moved downward, and fork 32 accommodating it must be modified accordingly.

FIG. 8 shows separative element 8*a* with support body 21 inserted into base profile 4, and with lever 1 in the position shown in FIG. 3 in which locking element 14 engages receptacle 91 located in floor 9 and provided with socket 92.

If the purpose is to lock separative element 8*a* only in regard to opening by rotation, receptacle 91 may also be in the form of a guide groove 93 along which separative element 8*a* is movably mounted. In this case, locking element 14 may also function as the lower guide for separative element 8*a* which is able to rotate after lever 1 is lifted.

As FIGS. 9, 10 and 11 show, head-piece 15 and fork 32 are preferably designed such that they are able to rotate toward each other in a plane perpendicular to separative elements 8*a*, 8*b*. Second separative element 8*b* may thus also move against first separative element 8*a* and locked to it, even when the second element is not aligned in the same plane with the first.

FIG. 9 is a bottom view of the two separative elements 8*a*, 8*b* oriented obliquely relative to each other, along with support body and installation body 21, 28, arrested by installation screws 28, 38, in corresponding base profiles 4. The two separative element 8*a*, 8*b* are coupled to each other in rotationally fixed fashion by head-piece 15 which has slid into fork 32.

FIG. 10 shows lever 1 and closing device 3, provided with additional elastic elements, specifically, damping elements 18, 34, by which impacts created when these device components meet and couple are attenuated.

Use of the additional elastic elements, possibly damping elements 18, 34, in lever 1, support device 2 or support unit 3 results in a greater flexibility in head-piece 15 and fork 32 such that the coupling action may be accomplished in a gentle fashion and with reduced noise emission—with the result that expenditures for maintenance are further reduced. This aspect is also especially advantageous when coupled separative elements 8*a*, 8*b* are moved and guided along guide rail 93 recessed in floor 9, which guide rail may function as receptacle 91 for locking element 14 provided in this case of longitudinal guidance and lateral locking. Separative elements 8*a*, 8*b* coupled and guided in this manner may thus move easily along curved tracks.

FIG. 10 also shows that fork 32 is formed by two fork plates 321, 322 connected to installation body 31, between which plates head-piece 15 may be inserted.

FIG. 11 is a schematic view of front piece 32 of closing device 3, the front piece being in the form of fork 32, which front piece is able to capture appropriately designed head-piece 15 from two different directions. To this end, head-piece 15 has the form of a wedge or parallelogram so as to allow this piece to be inserted into fork 32 from different directions. Head-piece 15 may also, for example, take the form of a vertically oriented cylinder or a sphere.

In the preferred embodiment of FIG. 11, head-piece 15 is also provided with guide elements 19 which enable automatic locking of device 100, as shown in FIGS. 12 and 13.

FIGS. 12 and 13 show closing device 3 in another preferred embodiment including a fork 32, the fork plates 321, 322 of which are provided with guide tracks 320 limited on both sides which serve to accommodate and to guide guide elements 19 provided on both sides of head-piece 15 of lever 1. Head-piece 15 of lever 1 is lowered such that it lies at the corresponding level of lower channel 42 of the base profile at both positions of lever 1.

FIG. 12 shows lever 1 in the first, unlocked, position in which it is rotated to the second position either manually or, as described below, by closing device 3, at which position device 100 is locked. In the first position, head-piece 15 is aligned such that its guide elements 19 are at the level of the entrance openings 324 of guide tracks 320, are inserted into these when the two separative elements 8*a*, 8*b* are moved together, and are moved along guide tracks 320, by which action lever 1 is rotated into the second position.

FIG. 13 shows lever 1 in the locked, second position. The action of moving apart separative elements 8*a*, 8*b* slides guide elements 19 upward along guide tracks 320, thereby unlocking device 100.

Arresting lever 1 in the second position thus prevents device 100 from being unlocked. Both separative elements 8*a*, 8*b* thus continue to be held rotationally fixed and unmovable. Arresting lever 1 is effected as shown, for example, in FIG. 13 by pin 5 which is routed above a rib 17 of lever 1 and against this lever located in the second position.

In an advantageous embodiment, a ramp 171 is provided below rib 17, by which ramp pin 5, supported by a spring, is moved automatically into the arrested position when lever 1 is lowered. Lever 1 is then released when pin 5 is retracted. To prevent lever 1 from being automatically arrested, pin 5 itself may preferably be arrested in the retracted position—an action achievable by simple means. For example, a slot 44 is provided in the base profile through which a crosspiece connected to pin 5 may be drawn, then rotated, and thus fixed. Head-piece 15 is in turn designed such that it is able to be inserted into fork 32 from different directions.

FIG. 14 shows closing device 3 with installation body 31, on which body two fork plates 321, 322 may be mounted, for example, by screws which pass through holes 39, 325 in installation body 31 and fork plates 321, 322. Fork plates 321, 322 are provided with guide tracks 320A, 320B, closed externally, which allow insertion of head-piece 15 of lever 1 in the first and in the second positions. In this embodiment, unlocked first separative element 8*a* may thus be locked, as described above, by insertion of guide element 19 into upper guide track 320A. In addition, first separative element 8*a* may be locked, after which guide element 19 inserts into lower guide track 320B as second separative element 8*b* approaches.

Appropriate design of the two guide tracks 320A, 320B may enable guide element 19 always to be shifted from guide track 320B to guide track 320A, or, after insertion into guide track 320A, to remain in this track. It is also possible to enable guide element 19 always to be shifted from guide track 320A into guide track 320B, or, after insertion into guide track 320B, to remain in this track.

FIG. 14 shows how lower guide track 320B moves lever 1 elastically downward, after which guide element 19 is able to spring upward after reaching upper guide track 320A and to be advanced by this track. In FIG. 15, guide element 19 is moved downward by guide track 320A into guide track 320B, where it remains.

In the design for guide tracks 320A, 320B of FIG. 14, first separative element 8*a* is thus always automatically unlocked when second separative element 8*b* moves away. In the design for guide tracks 320A, 320B of FIG. 15, first separative element 8*a* is not automatically unlocked, but must be unlocked manually, when second separative element 8*b* moves away.

FIGS. 16 and 17 provide a top and front view of closing device 3 with fork plates 321, 322 mounted.

Locking device 1 according to the invention has been described and presented in preferred embodiments. However, based on the teaching according to the invention, additional embodiments of the art may realized. Specifically, different designs and dimensions for components of the device may be chosen, specifically, for lever 1 and fork 32, as well as for elastic elements 7 or damping elements 18, 34. In addition, different fabrication materials, plastics, and metals may be employed to produce these components.

List of References
[1] European Patent 0537121A1
[2] German Patent 19538485C2
[3] WO 00/55460

List of Reference Notations
1 lever
11 shaft
12 indentation in end-piece 16
13 hole to receive shaft 11
14 locking element
15 head-piece
151 upper section of head-piece 15
16 end-piece
17 rib
171 ramp
18 damping element in lever 1
19 guide element
2 support device
21 support body
22 recess
23, 24 openings in support body 21
25 hole to accommodate shaft 11
26, 27 side plates
28 installation screws
29 threaded hole to accommodate installation screw 28
3 closing device
31 installation body
32 fork
320 guide track
320A upper guide track
320B lower guide track
321, 322 fork plates
324 entrance opening of guide track 320
325 hole in fork plates 321, 322
33 threaded hole to accommodate installation screw 38
34 damping element in installation body 31
38 installation screw
39 hole for installation body 31
4 base profile
5 pin
41 upper channel in base profile 4
42 lower channel in base profile 4
44 slot
5 pin
6 glass pane
7 elastic elements
71, 72 balls
73, 74 spring elements
8*a*, 8*b* first and second separative element
9 floor
91 receptacle
92 socket functioning as receptacle 91
93 guide rail functioning as receptacle 91
100 locking device

What is claimed is:

1. Device for locking a first laterally movable and/or rotatable door element and a second laterally movable door element; comprising:

a first base profile formed on the first door element and a second base profile formed on the second door element, the first and second base profiles being in the form of an H with an upper channel accommodating a pane and a lower channel, said lower channel of the first base profile of slideably holding a support device that is fixed within the lower channel and that comprises a shaft, by which a lever with a head-piece and a locking element is retained rotatable between an unlock position and lock position in which the locking element engages a receptacle fixed on the floor, and wherein the support device is a bearing for the lever in such a way, that the lever which projects along the longitudinal axis out of the first base profile as well as may engage with the lower channel of the second base profile or a closing device provided therein and wherein at least one elastic element is provided, that interacts between the support device and the lever and that detachably fixes the lever at least in the unlock position.

2. Locking device according to claim 1, the at least one elastic element including two elastic elements which detachably fix the lever in the lock position.

3. Locking device according to claim 1, wherein the support device has a support body which is connected by the shaft to an end-piece of the lever projecting into a recess of the support body.

4. Locking device according to claim 2, wherein the elastic element comprises a ball supported by a spring element, that is provided in an opening of the support body, and that presses the ball at the unlock or lock position of the lever, into a first or second indentation provided in the end-piece of the lever.

5. Locking device according to claim 1, wherein the locking element, which takes the form of a tappet or pin, is located in the region of the head-piece on the side of the lever facing away from the first door element.

6. Locking device according to claim 1, wherein the head-piece can be captured or captured and actuated, either manually or by the closing device which comprises an installation body that is mounted in the lower channel of the second base profile.

7. Locking device according to claim 6, wherein the head-piece can be inserted either into the lower channel of the second base profile or into a fork extending from the installation body of the closing device.

8. Locking device according to claim 7, wherein the fork is provided with two fork plates which have at least one guide track into which guide elements of the head-piece are able to be inserted.

9. Locking device according to claim 8, wherein a ramp-like guide track is provided designed to receive and move the guide elements of the head-piece therein during the mutual movement of the two door elements in such a way that the lever is rotated between the unlock and lock position; and/or a straight guide track is provided designed to receive the guide elements of the head-piece whenever the lever is located in the lock position.

10. Locking device according to claim 9, wherein the guide tracks merge, and are designed such that the guide elements are shifted from the ramp-like guide tracks to the straight guide tracks, or from the straight guide tracks to the ramp-like guide tracks.

11. Locking device according to claim 7, wherein the head-piece and the fork are designed such that the head-piece is able to be inserted into the fork and is rotatable therein.

12. Locking device according to claim 11, wherein the head-piece is of a wedge-shaped or spherical form.

13. Locking device according to claim 6, wherein at least the lever, the support device, or the closing device is provided with a damping element.

14. Locking device according to claim 2, wherein means are provided to arrest the lever in the lock position.

15. Locking device according to claim 2, wherein the head-piece can be captured and actuated, either manually or by the closing device provided in the second base profile.

16. Locking device according to claim 3, wherein the head-piece can be captured and actuated, either manually or by the closing device provided in the second base profile.

17. Locking device according to claim 4, wherein the head-piece can be captured and actuated, either manually or by the closing device provided in the second base profile.

18. Locking device according to claim 5, wherein the head-piece can be captured and actuated, either manually or by the closing device provided in the second base profile.

* * * * *